US005469937A

United States Patent [19]

Hakala et al.

[11] Patent Number: 5,469,937

[45] Date of Patent: Nov. 28, 1995

[54] TRACTION SHEAVE ELEVATOR WITH DRIVE MACHINE BELOW

[75] Inventors: Harri Hakala, Hyvinkää; Esko Aulanko, Kerava, both of Finland

[73] Assignee: Kone Oy, Helsinki, Finland

[21] Appl. No.: 264,340

[22] Filed: Jun. 23, 1994

[30] Foreign Application Priority Data

Jun. 28, 1993 [FI] Finland ..... 932975

[51] Int. Cl.[6] ..... B66B 11/04

[52] U.S. Cl. ..... 187/266; 187/404

[58] Field of Search ..... 187/20, 22, 94, 187/95, 266, 404, 254

[56] References Cited

U.S. PATENT DOCUMENTS 3,101,130 8/1963 Bianca ..... 187/20

FOREIGN PATENT DOCUMENTS 1032496 7/1958 Germany ..... 187/20
5078066 3/1993 Japan ..... 187/20
1252279 8/1986 U.S.S.R. ..... 187/20

*Primary Examiner*—Kenneth Noland

[57] ABSTRACT

The invention relates to a traction sheave elevator with drive machine below, comprising an elevator car (1) moving along elevator guide rails (10), a counterweight moving along counterweight guide rails (11), a set of hoisting ropes (3) supporting the elevator car and the counterweight, and in the bottom part of the elevator shaft a drive machine unit (6) comprising a traction sheave (7) driven by the drive machine and engaging the hoisting ropes (3). The drive machine unit (6) of the elevator is placed below the path of the counterweight (2). In the direction of the thickness of the counterweight, the drive machine unit (6) is placed substantially inside the shaft space extension required by the counterweight (2) on its path, including the safety distance.

16 Claims, 3 Drawing Sheets

TRACTION SHEAVE ELEVATOR WITH DRIVE MACHINE BELOW

FIELD OF THE INVENTION

The present invention relates to a traction sheave elevator 6.

DESCRIPTION OF BACKGROUND ART

One of the objectives aimed at in the development of elevators has been an efficient and economic use of building space. In conventional traction-sheave driven elevators, the elevator machine room or other space reserved for the drive machinery takes up a considerable portion of the building space required by the elevator. The problem is not only the volume of the building space needed for the elevator, but also its location in the building. There are numerous solutions to the placement of the machine room, but they generally significantly restrict the design of the building at least in respect of space utilization or appearance. For example, for an elevator with the machine placed beside the bottom part of the shaft, the building has to be provided with a machine room or space placed beside the shaft, generally on the lowest floor served by the elevator. Being a special space, the machine room generally involves increased building costs.

With respect to utilization of space, hydraulic elevators are relatively advantageous, and they often allow the entire drive machine to be placed in the elevator shaft. Hydraulic elevators are applicable in cases where the lifting height is one floor or at most a few floors. In practice, hydraulic elevators cannot be constructed for very large heights.

OBJECTS OF THE INVENTION

To meet the need to achieve a reliable elevator which is advantageous in respect of economy and utilization of space and for which the space requirement in the building, irrespective of the hoisting height, is substantially limited to the space required by the elevator car and counterweight on their paths including the safety distances and the space needed for the hoisting ropes, and in which the above-mentioned drawbacks can be avoided, a new type of traction sheave elevator is presented as an invention. The traction sheave elevator of the invention is characterized by the drive machine unit of the elevator being placed below the path of the counterweight. In the thicknesswise direction of the counterweight, the drive machine unit is placed substantially inside the shaft space extension required by the counterweight on its path, including the safety distance.

The advantages which can be achieved by applying the present invention include the following:

- The traction sheave elevator of the invention allows an obvious space saving to be achieved in the building because no separate machine room is needed.
- Efficient utilization of the cross-sectional area of the elevator shaft.
- Advantages in installation because the system has fewer components than in conventional elevators with drive machine below.
- In elevators implemented using the invention, the ropes meet the traction sheave and diverting pulleys from a direction aligned with the rope grooves of the diverting pulleys, a circumstance which reduces rope wear.
- In elevators implemented using the invention, it is not difficult to achieve a centric suspension of the elevator car and counterweight and therefore a substantial reduction of the supporting forces applied to the guide rails. This permits the use of lighter guide rails as well as lighter elevator and counterweight guides.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of an embodiment presented as an example, by referring to the attached drawings which are given by way of illustration only, and thus are not limitative of the present invention and in which.

DETAILED DESCRIPTION OF THE PREFERRED EMBODIMENTS

Figure 1:
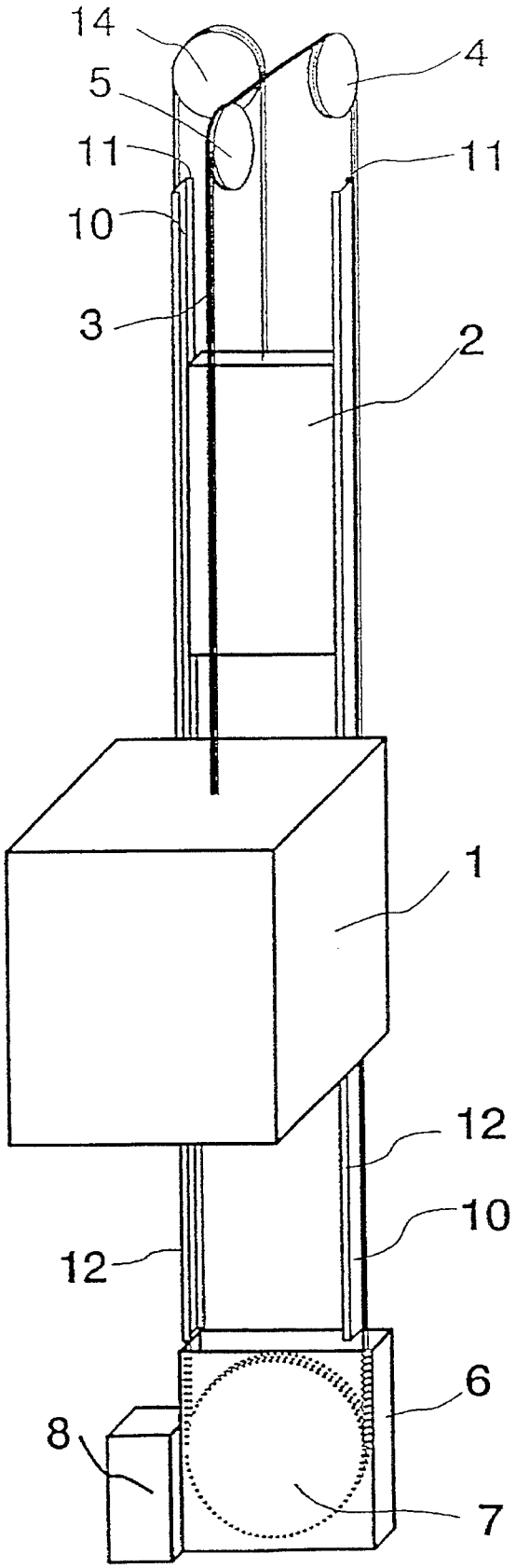
FIG. 1 presents a diagram representing a traction sheave elevator according to the invention.

A traction sheave elevator according to the invention is presented in FIG. 1 in diagammtic form. This is a type of traction sheave elevator which has the drive machine below. The elevator car 1 and counterweight 2 are suspended on the hoisting ropes 3 of the elevator. The hoisting ropes 3 preferably support the elevator car 1 substantially centrically or symmetrically relative to the vertical line passing via the center of gravity of the elevator car 1. Similarly, the suspension of the counterweight 2 is preferably substantially centric or symmetrical relative to the vertical line going through the center of gravity of the counterweight. The drive machine unit 6 of the elevator is placed at the bottom part of the elevator shaft and the hoisting ropes 3 are passed over diverting pulleys 4,5,14 at the top part of the elevator shaft to the car 1 and to the counterweight. The hoisting ropes 3 usually consist of several ropes 102 placed side by side, usually at least three ropes.

The elevator car 1 and the counterweight 2 travel in the elevator shaft along elevator and counterweight guide rails 10,11 which guide them and are placed in the shaft on the same side relative to the elevator car. The elevator car is suspended on the guide rails in a manner called rucksack suspension, which means that the elevator car 1 and its supporting structures are almost entirely on one side of the plane between the elevator guide rails 10. The elevator and counterweight guide rails 10,11 are implemented as an integrated rail unit 12 having guide surfaces for guiding the elevator car 1 and the counterweight 2. Such a rail unit can be installed faster than separate guide tracks.

In FIG. 1, the hoisting ropes 3 run as follows: One end of the hoisting ropes is attached to the counterweight 2, from which the ropes go upwards in the same direction with the path of the counterweight until they meet a diverting pulley 14 rotatably mounted at the top part of the shaft. Having passed around the diverting pulley 14, the ropes 3 go downwards to the traction sheave 7, passing around it along rope grooves. From the traction sheave 7 the ropes go back to the top part of the elevator shaft, where the passage of the ropes 3 is so guided by diverting pulleys 4,5 rotatably mounted at the top part of the shaft that the first diverting pulley 4 receives the ropes coming from the traction sheave 7, and from the second pulley the ropes go to the elevator car 1. Diverting pulleys 4 and 5 rotate in substantially the same plane. The position of diverting pulley 5 in the horizontal direction and the rope anchorage point on the elevator car 1 are preferably so aligned relative to each other that the ropes run from diverting pulley 5 to the elevator car 1 substantially in the direction of the path of the elevator car 1.

The drive machine unit 6 placed below the path of the counterweight 2 is of a flat construction as compared to the width of the counterweight, its thickness being preferably at most equal to that of the counterweight, including the equipment that may be needed for the supply of power to the motor driving the traction sheave 7 as well as the necessary elevator control equipment, both of said equipments 8 being adjoined to the drive machine unit 6, possibly integrated with it. All essential parts of the drive machine unit 6 with the associated equipments 8 are, in the thicknesswise direction of the counterweight, within the shaft space extension required by the counterweight 2 on its path, including the safety distance. Outside of this extension may only go some parts inessential to the invention, such as the lugs (not shown in the figures) needed to fix the drive machinery to the floor of the elevator shaft, or the brake handle. Elevator regulations typically require a 25-mm safety distance from a movable component, but even larger safety distances may be applied because of certain country-specific elevator regulations or for other reasons.

A preferable drive machinery consists of a gearless machine with an electromotor whose rotor and stator are so mounted that one is immovable with respect to the traction sheave 7 and the other with respect to the frame of the drive machine unit 6. The essential parts of the motor are inside the rim of the traction sheave. The action of the operating brake of the elevator is applied to the traction sheave. In this case the operating brake is preferably integrated with the motor. In practical applications, the solution of the invention regarding the machinery means a maximum thickness of 20 cm for small elevators and 30–40 cm or more for large elevators with a high hoisting capacity.

The drive machine unit 6 with the motor can be of a very flat construction. For example, in an elevator with a load capacity of 800 kg, the rotor of the motor of the invention has a diameter of 800 mm and the minimum thickness of the whole drive machine unit is only about 160 mm. Thus, the drive machine unit used in the invention can be easily accommodated in the space according to the extension of the counterweight path. The large diameter of the motor involves the advantage that a gear system is not necessarily needed.

Figure 2:
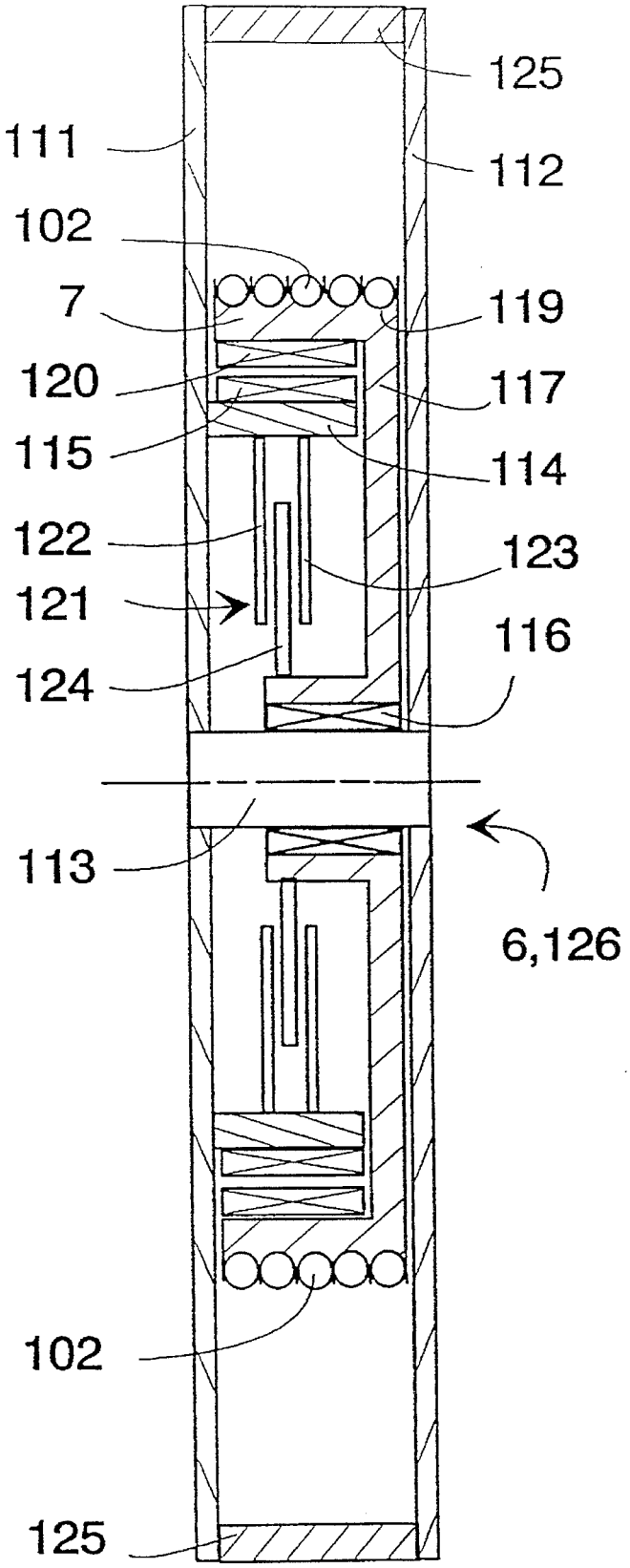
FIG. 2 presents a cross-section of a hoisting machine unit applied in the invention.

FIG. 2 presents a cross-section of the drive machine unit 6, showing the elevator motor 106 in top view. The motor 106 is implemented as a structure suitable for a drive machine unit 6 by making the motor 106 from parts usually called end-shields and an element 111 supporting the stator and at the same time forming a side plate of the drive machine unit. The side plate 111 thus constitutes a frame part transmitting the load of the motor and at the same time the load of the drive machine unit. The unit has two supporting elements or side plates, 111 and 112, which are connected by an axle 113. Attached to side plate 111 is the stator with a stator winding 115 on it. Alternatively, side plate 111 and the stator can be integrated into a single structure. The rotor 117 is mounted on the axle 113 by means of a bearing 116. The traction sheave 7 on the outer surface of the rotor 117 is provided with five rope grooves 119. Each one of the five ropes 102 goes about once around the traction sheave. The traction sheave 7 may be a separate cylindrical body placed around the rotor 117, or the rope grooves of the traction sheave 7 may be made directly on the outer surface of the rotor as shown in FIG. 2. The rotor winding 120 is placed on the inner surface of the rotor. Between the shator 114 and the rotor 117 is a brake 121 consisting of brake plates 122 and 123 attached to the stator and a brake disc 124 rotating with the rotor. The axle 113 is fixed to the stator, but alternatively it could be fixed to the rotor, in which case the bearing would be between the rotor 117 and side plate 111 or both side plates 111 and 112. Side plate 112 acts as an additional reinforcement and stiffener for the motor/drive machine unit. The horizontal axle 113 is fixed to opposite points on the two side plates 111 and 112. Together with connecting pieces 125, the side plates form a box-like structure.

Figure 3:
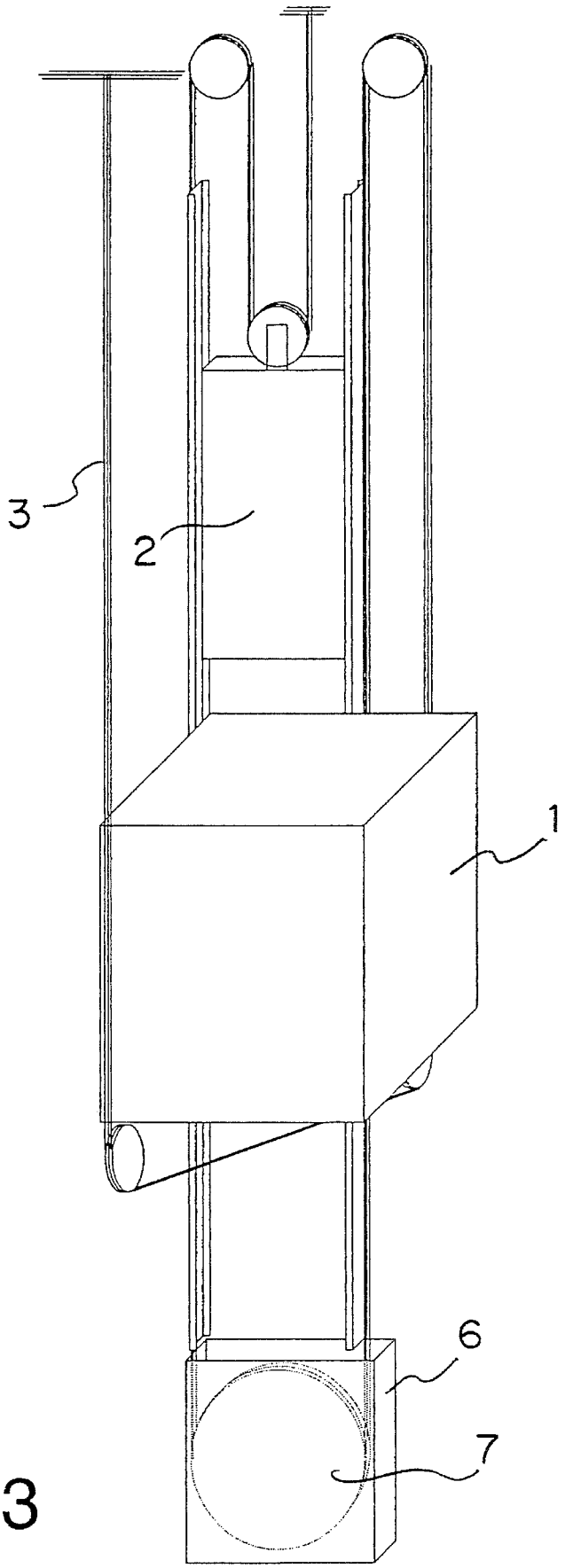
FIG. 3 presents a second embodiment of the traction sheave elevator according to the invention.

It is obvious to a person skilled in the art that different embodiments of the invention are not restricted to the examples described above, but that they may instead be varied within the scope of the following claims. For example, the number of times the hoisting ropes are passed between the top part of the elevator shaft and the counterweight or elevator car is not very decisive with regard to the basic advantages of the invention, although it is possible to achieve some additional advantages by using multiple rope stretches. In general, applications should be so designed that the ropes go to the elevator car at most as many times as to the counterweight. In addition to the above-described suspension in which the ropes go in single rope stretches both to the elevator car and to the counterweight, preferable suspension arrangements are those in which the ratio of the numbers of rope stretches going to the elevator car and to the counterweight is 2:2, 2:1 or 3:2, and in which at least the counterweight is suspended on the ropes by means of a diverting pulley. In suspension arrangements where the ratio of the numbers of rope stretches is 2:1 or 3:2, the path of the counterweight is shorter than that of the car, which, together with the placement of the drive machinery below the path of the counterweight, provides the possibility to make the elevator shaft slightly shorter than in the case of suspension arrangements where the corresponding ratio is 1:1 or 2:2. When this ratio is 2:2 or 3:2, it is often preferable to pass the ropes under the car, e.g. diagonally with respect to the car floor as shown in FIG. 3. A suspension arrangement where the ropes go diagonally under the floor of the car provides an advantage regarding elevator lay-out because the vertical portions of the ropes are close to the corners of the car and are therefore not an obstacle e.g. to placing the door on one of the sides of the car 1.

It is also obvious to the skilled person that the larger machine size needed for elevators designed for heavy loads can be achieved by increasing the diameter of the electromotor, without substantially increasing the thickness of the drive machinery.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A traction sheave elevator with drive machine below, comprising:

an elevator car moving along elevator guide rails in an elevator shaft;

a counterweight moving along counterweight guide rails, the counterweight being movable along a counterweight path;

a set of hoisting ropes on which the elevator car and the counterweight are suspended; and a drive machine unit located in a bottom part of the elevator shaft, the drive machine unit comprising a traction sheave and means for driving the traction sheave, the traction sheave engaging the hoisting ropes, the drive machine unit being placed below the counterweight path, the drive machine unit in a thicknesswise direction of the counterweight being placed substantially inside a shaft space extension required by the counterweight on the path thereof including a safety distance for the counterweight.

2. The traction sheave elevator according to claim 1, wherein the drive machine unit is completely inside the shaft space driving the traction sheave comprises a motor and further comprising equipment required for supply of power to the motor driving the traction sheave, the equipment being adjoined to the motor.

3. The traction sheave elevator according to claim 2, wherein the equipment is integrated with the drive machine unit.

4. The traction sheave elevator according to claim 1, wherein the drive machine unit is gearless and has a thickness not exceeding that of the counterweight.

5. The traction sheave elevator according to claim 1, wherein a plane of rotation of the traction sheave comprises in the drive machine unit is substantially parallel to a plane between the counterweight guide rails.

6. The traction sheave elevator according to claim 1, wherein portions of the hoisting ropes from which the elevator car and the counterweight are suspended run substantially in a direction of the paths of the elevator car and the counterweight.

7. The traction sheave elevator according to claim 1, wherein the elevator car is suspended using rucksack-type suspension and wherein the guide rails for the elevator car and counterweight are on a same side of the elevator car.

8. The traction sheave elevator according to claim 7, wherein the counterweight guide rail and the elevator guide rail are integrated into a guide rail unit provided with guide surfaces for both the counterweight and the elevator car.

9. The traction sheave elevator according to claim 1, further comprising a diverting pulley for suspending the counterweight on the hoisting ropes.

10. The traction sheave elevator according to claim 1, further comprising at least one diverting pulley for suspending the counterweight and the elevator car on the hoisting ropes.

11. The traction sheave elevator according to claim 1, wherein the elevator car and the counterweight are suspended on the hoisting ropes so that the path of the counterweight is shorter than the path of the elevator car.

12. The traction sheave elevator according to claim 1, wherein the hoisting ropes are passed under the elevator car via two diverting pulleys.

13. The traction sheave elevator according to claim 12, wherein the hoisting ropes pass diagonally under a floor of the elevator car.

14. The traction sheave elevator according to claim 1, further comprising a diverting pulley located above the counterweight path, the hoisting ropes passing from the traction sheave, over the diverting pulley and to the counterweight, the traction sheave and the diverting pulley being rotatable about axes which are generally parallel.

15. The traction sheave elevator according to claim 1, wherein the hoisting ropes fail to pass beneath the elevator car.

16. The traction sheave elevator according to claim 1, wherein the hoisting ropes between the traction sheave and the counterweight fail to pass beneath the elevator car.

* * * * *

UNITED STATES PATENT AND TRADEMARK OFFICE

CERTIFICATE OF CORRECTION

PATENT NO. : 5,469,937

DATED : November 28, 1995

INVENTOR(S) : Harri HAKALA et al.

It is certified that error appears in the above-indentified patent and that said Letters Patent is hereby corrected as shown below:

Claim 2, line 3, after "space" insert --, and for--; and after "sheave" insert --the drive machine unit--.

Claim 2, line 4, delete "further comprising".

Claim 5, line 2, delete "comprises".

Signed and Sealed this

Twenty-seventh Day of May, 1997

*Attest:*

Bruce Lehman

BRUCE LEHMAN

*Attesting Officer*

*Commissioner of Patents and Trademarks*